US007094329B2

(12) United States Patent
Saha et al.

(10) Patent No.: US 7,094,329 B2
(45) Date of Patent: Aug. 22, 2006

(54) PROCESS OF PRODUCING PEROXO-CARBONATE

(75) Inventors: Madhu Sudan Saha, Fujisawa (JP); Masaharu Uno, Fujisawa (JP); Yoshinori Nishiki, Fujisawa (JP); Tsuneto Furuta, Fujisawa (JP); Tateki Kurosu, Hiratsuka (JP)

(73) Assignee: Permelec Electrode Ltd., Kanagawa (JP)

( * ) Notice: Subject to any disclaimer, the term of this patent is extended or adjusted under 35 U.S.C. 154(b) by 2 days.

(21) Appl. No.: 10/953,578

(22) Filed: Sep. 30, 2004

(65) Prior Publication Data

US 2005/0224363 A1 Oct. 13, 2005

(30) Foreign Application Priority Data

Nov. 11, 2003 (JP) ..... 2003-381105

(51) Int. Cl.
*C25B 1/28* (2006.01)

(52) U.S. Cl. ..... 205/465; 205/466; 205/468

(58) Field of Classification Search ..... 205/465, 205/466, 468

See application file for complete search history.

(56) References Cited

U.S. PATENT DOCUMENTS 6,254,762 B1 * 7/2001 Uno et al. ..... 205/466

FOREIGN PATENT DOCUMENTS

SU 1815262 * 5/1993

* cited by examiner

*Primary Examiner*—Arun S. Phasge
(74) *Attorney, Agent, or Firm*—Sughrue Mion, PLLC

(57) ABSTRACT

An industrially useful peroxo-carbonate is electrolytically produced using, as a raw material, carbon dioxide that is inexpensive and easily available. A process of producing a peroxo-carbonate, includes feeding a carbon dioxide gas into an electrolytic cell having a gas diffusion anode and a cathode, or feeding a liquid having a carbon dioxide gas dissolved therein into an electrolytic cell having an anode and a cathode, and electrolytically converting the carbon dioxide gas into a peroxo-carbonate. By properly setting up electrolytic conditions such as electrodes, a useful peroxo-carbonate can be produced with high current efficiency using inexpensive carbon dioxide as the raw material.

14 Claims, 3 Drawing Sheets

PROCESS OF PRODUCING PEROXO-CARBONATE

FIELD OF THE INVENTION

The present invention relates to a production process for synthesizing inexpensively and simply a peroxo-carbonate that is an industrially important oxidizing agent and is used as a bleaching agent or a disinfectant.

DESCRIPTION OF THE RELATED ART

Adverse influences against the environment and human bodies due to the atmospheric pollution caused by industrial or living wastes and the deterioration of water quality in rivers and lakes and marshes become serious. Technical countermeasures for solving this problem are an urgent issue. For example, in drinking water, sewage treatment and waste water treatment, chemicals having an oxidizing power have been used for decoloration, reduction of COD, or sterilization. However, because of the use of a large quantity of such chemicals, new dangerous substances, i.e., endocrine disputing chemicals and carcinogenic substances, tend to be formed. Furthermore, in the incineration treatment of final wastes, carcinogenic substances (dioxins) are generated in the waste gas depending upon the incineration condition, thereby influencing the ecological system, and therefore, the safety thereof is of a problem. To solve this problem, a new method is investigated.

Electrolysis method makes it possible to induce a desired electrochemical reaction utilizing clean electric energy. By controlling the chemical reaction on the surface of a cathode, that is, by feeding an oxygen-containing gas and water into a cathode, it is possible to produce hydrogen peroxide. The water treatment of decomposing substances to be treated by utilizing this electrolysis method has hitherto been widely carried out. According to the electrolysis method, it becomes possible to realize the on-site production of hydrogen peroxide. In addition, this electrolysis method overcomes such a defect of hydrogen peroxide that it cannot be stored over a long period of time without using a stabilizing agent. Further, this method is free from a danger following the conveyance and does not require a countermeasure for pollution.

The water treatment method utilizing a chlorine based oxidizing agent such as hypochlorous acid, sodium hypochlorite, sodium chlorite or bleaching powder is most commonly employed. However, this method involved such a problem in safety that a noxious and dangerous oxidizing agent must be conveyed and stored on the treatment spot. On-site type electrolytic devices are commercially available and can solve the problems regarding the storage and conveyance. However, there is some possibility of forming noxious organic chlorine compounds represented by trihalomethanes in a reaction step of hypochlorous acid and an organic material, and the possibility of a secondary pollution is pointed out.

As other chemical oxidation treatment methods, JP-A-6-99181 discloses a method of undergoing heat treatment using a peroxosulfate as an oxidizing agent. According to this method, no organic chlorine compound is formed, and the peroxosulfate changes into a sulfate after the decomposition treatment, and therefore, no sludge is generated. However, in this method, since the peroxosulfate is directly added, a large quantity of the peroxosulfate as a strong oxidizing agent must be stored, leading to a problem in safety.

In contrast to this, although a peroxo-carbonate is inferior to chlorine based chemicals with respect to oxidizing ability, sterilizing ability and bleaching ability, it has various adequate abilities so that it is generalized as a basic raw material of various detergents. This peroxo-carbonate is present as a percarbonate that is a stable alkaline white particulate solid at normal temperature (a 3% sodium percarbonate aqueous solution exhibits a pH of 10–11), an innocuous component to the environment is used, and it is well soluble in water at normal temperature and has a relatively strong oxidizing action. In view of those characteristics, the peroxo-carbonate is widely used as household and business bleaching agents and detergents. Specifically, it is applied to bleaching agents for clothing, bleaching agents for laundry, synthetic detergents, cleaning agents for bath boiler, cleaning agents for kitchen draining pipe, cleaning agents for tableware, cleaning agents for denture, and stain removing agents, and is used in arbitrary places of the inside and outside of home, where the stain removal or odor elimination is required. A representative formulation of commercially available detergents using a peroxo-carbonate contains 30–75% of sodium percarbonate and 25–50% of a carbonate and additionally oxygen and surfactants.

When a percarbonate is dissolved in water, hydrogen peroxide is formed, and the hydrogen peroxide generates oxygen upon heating.

Hitherto, the percarbonate has been obtained as a precipitate by electrolytically oxidizing a concentrated aqueous solution of a carbonate such as potassium carbonate at low temperatures according to the following formulation.

$$2CO_3^{2-} \rightarrow C_2O_6^{2-} + 2e^-$$

Further, JP-T-9-504827 (a published Japanese translation of a PCT application) discloses the production of a peroxo-carbonate by oxygen reduction of an alkali metal carbonate using an oxygen diffusion cathode. *ENCYCLOPAEDIA CHIMICA*, item of "peroxocarbonate", Kyoritsu Shuppan Co., Ltd. discloses a production process by electrolysis of a percarbonate (peroxodicarbonate) by the electrolysis method.

Besides, methods of synthesizing a peroxo-carbonate by exerting hydrogen peroxide and a carbonate such as sodium carbonate, or sodium peroxide and carbon dioxide are also known. T. S. Price, et al. propose a preparation method of a peroxo-carbonate (see *Per-Acids and Their Salts,* p.65, 1912).

In the above-described method of producing peroxo-carbonate compounds from hydrogen peroxide, hydrogen peroxide is dangerous and hardly stored, and therefore, in many cases, the on-site production is rather difficult. In the above-described synthesis by low-temperature electrolytic oxidation, platinum or nickel is used as an anode, and the electrolysis method is safe and easy. However, this method involves such a defect that the current efficiency is low so that the method is poor in economy. Further, in the electrolytic production process described in JP-T-9-504827, there is no description regarding the specific electrolysis condition and yield at all, and therefore, it may be thought that this process has not been carried out on a commercial basis yet.

In the light of the above, synthesis methods of peroxo-carbonate compounds with safety and high efficiency have not been substantially found out.

On the other hand, various industrial processes, energy-related businesses, incineration of wastes, and the like are the major cause of increasing carbon dioxide in the air. As a result, the environmental pollution and the green house effect increase. If it would be possible to recycle carbon dioxide as a chemical product, the foregoing problem should be relieved. For example, conversion of carbon dioxide is carried out by hydrogenation in the presence of a heterogeneous catalyst at high temperatures, under critical conditions, or by electrochemical or photochemical reaction. However, in these reactions, it is important that necessary energy is cut as far as possible, that the reaction rate is increased, and that the value of the resulting product is high.

SUMMARY OF THE INVENTION

In view of the problems of the above related art technologies, the present invention has been made.

Accordingly, an object of the present invention is to provide a method that can synthesize a peroxo-carbonate with safety and relatively high efficiency by electrolysis using a readily available carbon dioxide gas as the raw material.

The present invention provides a process of producing a peroxo-carbonate, which comprises feeding a carbon dioxide gas into an electrolytic cell having a gas diffusion anode and a cathode and electrolytically converting the carbon dioxide gas into a peroxo-carbonate.

IN THE DRAWINGS

Figure 1:
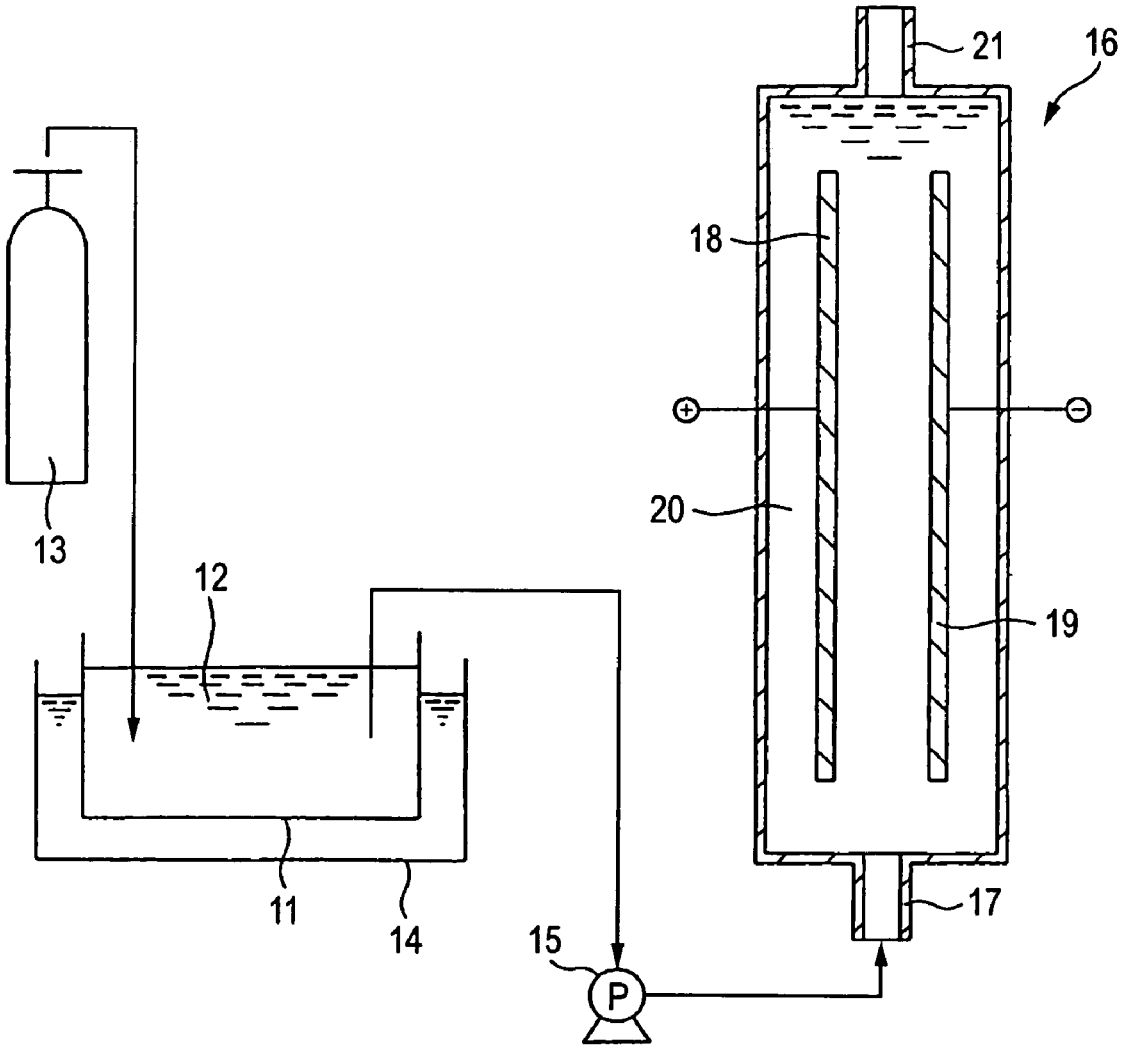
FIG. 1 is a flowchart showing one embodiment of electrolytic lines containing an electrolytic cell capable of being used for the production of a peroxo-carbonate according to the present invention.

11: Electrolytic solution storage tank
12: Electrolytic solution
13: Carbon dioxide gas cylinder
16: Electrolytic cell for producing peroxo-carbonate
31: Diaphragm type electrolytic cell
32: Diaphragm
34: Gas diffusion anode
35: Anolyte chamber
36: Anode gas chamber
39: Electrolytic solution storage tank
40: Electrolytic solution
41: Carbon dioxide gas cylinder

DETAILED DESCRIPTION OF THE INVENTION

The present invention is described in detail below.

The "peroxo-carbonate" as referred to herein generically means peroxo-carbonate ($H_2CO_4$) itself; peroxo-carbonate compounds, for example, percarbonates such as sodium percarbonates (for example, $Na_2CO_4$ or $Na_2C_2O_6$) or potassium percarbonate; hydrates and/or hydrogen peroxide adducts thereof (for example, $Na_2CO_4.H_2O_2.0.5H_2O$, $Na_2CO_4.0.5H_2O$, or $Na_2CO_4.H_2O_2$); and peroxo-carbonate ions (for example $CO_4^{2-}$ or $C_2O_6^{2-}$).

In the production of a peroxo-carbonate according to the present invention, carbon dioxide is used as the raw material. The peroxo-carbonate may be produced by dissolving this carbon dioxide in an electrolytic solution, feeding this solution as a liquid phase into an electrolytic cell and subjecting it to anodic oxidation, or by feeding the carbon dioxide as a gaseous phase into an electrolytic cell having a gas diffusion electrode as an electrode and subjecting it to anodic oxidation. Regardless of whether or not carbon dioxide is dissolved, the electrolytic solution is required to be conductive. For this reason, it is necessary to dissolve an electrolyte such as sodium hydroxide or potassium hydroxide in an amount of preferably 0.1–2 M, and more preferably 1–2 M, in the electrolytic solution. The electrolytic solution of the present invention preferably has high pH, for example, 7–14, preferably 10–12, and more preferably 12. In order to maintain the alkaline electrolytic solution at a prescribed pH, a buffer solution of, for example, a carbonate or a hydrogencarbonate, can be used.

Carbon dioxide reacts with a hydroxyl ion to form a carbonate ion or a hydrogencarbonate ion as shown in the following reaction formula (1) or (2).

$$CO_2+OH^- \rightarrow HCO_3^- \quad (1)$$

$$HCO_3^-+OH^- \rightarrow CO_3^{2-}+H_2O \quad (2)$$

This carbonate ion or hydrogencarbonate ion reacts with an active radical such as a hydroxyl radical and is converted into a percarbonate ion as shown in the following reaction formula (3). This hydroxyl radical is, for example, formed on the surface of a boron-doped conductive diamond anode according to the following reaction formula (4).

$$2HCO_3^-+2OH^* \rightarrow C_2O_6^{2-}+2H_2O \quad (3)$$

$$H_2O \rightarrow OH^*+H^++e^- \quad (4)$$

In general, the anodic reaction in the electrolysis of an aqueous solution is an electrolytic reaction in which water is the raw material. However, when an electrode catalyst having high reactivity against electric discharge of water, the oxidation of other co-existing substances does not often proceed with ease. Usual oxidizing catalysts are, for example, lead oxide, tin oxide, platinum, platinum group metal oxides, iron, and nickel.

Even when electrolytic synthesis of peroxo-carbonate compounds from carbon dioxide is performed using such an electrode substance, the decomposition of water preferentially occurs, whereby the formation of a peroxo-carbonate does not substantially proceed.

Examples of electrode substances capable of achieving the electrolytic synthesis of a peroxo-carbonate from carbon dioxide with high efficiency include conductive diamond, platinum, and nickel.

Diamond is excellent with respect to heat conductivity, optical permeability, high-temperature durability and oxidation durability. In addition to the excellent mechanical and chemical stability, conductive diamond to which good electrical conductivity can be imparted upon doping is an anodic substance useful for the electrolytic synthesis of a peroxo-carbonate via a carbonate ion and/or a bicarbonate ion from carbon dioxide.

The conductive diamond electrode has a high oxygen overvoltage. When carbon dioxide is electrolyzed using an anode made of conductive diamond as a catalyst, the carbon dioxide is dissolved as a carbonate ion and/or a bicarbonate ion, which is oxidized to form a peroxo-carbonate, as described previously. The formation of this peroxo-carbonate occurs preferentially to the generation of oxygen by oxidation of water, whereby the peroxo-carbonate can be electrolytically synthesized with high efficiency.

In the case of using other electrode substances than conductive diamond, it can be estimated that a peroxo-carbonate is also formed in substantially the same manner.

The reaction of a cathode as a counter electrode includes the case where the reaction is carried out while feeding an oxygen-containing gas using a gas diffusing cathode and the case where the usual hydrogen generation reaction is carried out, each of which proceeds according to the following reaction formula (5), (6) or (7).

Case where oxygen is not fed:

$$\text{Cathode: } 2H_2O+2e^- \rightarrow H_2+2OH^- \quad (5)$$

Case where oxygen is fed:

$$\text{Cathode: } O_2+H_2O+2e^- \rightarrow HO_2^-+OH^- \quad (6)$$

$$\text{Cathode: } O_2+H_2O+4e^- \rightarrow 4OH^- \quad (7)$$

Carbon dioxide that is used as the raw material in the present invention is available at very low price, and a commercially available carbon dioxide-containing cylinder may be conveyed into the peroxo-carbonate production site and used. Even when leakage occurs, there is no danger, and a desired peroxo-carbonate (including its compounds) can be produced inexpensively and surely.

In feeding carbon dioxide into an electrolytic cell, an appropriate feeding system is employed depending upon the electrode structure.

Specifically, where a usual metal electrode or diamond electrode is used, a carbon dioxide gas is dissolved in an electrolytic solution by means of bubbling or the like, the resulting electrolytic solution is fed into an electrolytic cell, and carbon dioxide in the electrolytic solution is brought into contact with the anode surface to produce a peroxo-carbonate according to the above-described reaction. In the case of this feeding system, it is desired to dissolve carbon dioxide in the saturated state, and it is preferable that the electrolytic solution is cooled when dissolving the carbon dioxide to increase the saturated solubility. Further, it is desired to increase the pressure to increase the saturated solubility of carbon dioxide.

On the other hand, where the &node is a gas diffusion electrode, a carbon dioxide gas is fed into an anode gas chamber as it is, and the carbon dioxide is brought into contact with the gas diffusion anode surface to produce a peroxo-carbonate according to the above-described reaction.

The electrode having conductive diamond (conductive diamond electrode) that can be used in the present invention is produced by the heat filament CVD (chemical vapor deposition) process, the microwave plasma CVD process, the plasma arc jet process, the physical vapor deposition (PVD) process, and the like. Specifically, for example, the conductive diamond electrode is produced by supporting diamond as a reduction deposit of an organic carbon, which will become a carbon source, on an electrode substrate to form a conductive diamond layer. Besides, diamond electrodes in which a synthetic diamond powder produced under ultra-high pressure is supported on a substrate using a binder such as resins can be used. In particular, when a hydrophobic component such as fluorine resins is present on the electrode surface, carbon dioxide is liable to be trapped, whereby the reaction efficiency is enhanced.

The conductive diamond electrode can be, for example, produced in the following manner.

A mixed gas comprising raw materials containing an organic compound as a carbon sources and further hydrogen, boron (or nitrogen), and the like is activated under a pressure of 1–100 kPa on a hot filament heated at 1,800–2,600° C. to generate a carbon radical and a hydrogen radical. In this regard, it is desired that a volume ratio of hydrogen to the carbon gas raw material is controlled at about 0.05/1 to 1/1.

Methane can be used as the carbon source, and diborane can be used as the boron source. Besides, alcohols and boron oxide can also be used, respectively. The latter is preferable from the standpoint of safety on the production spot. The doping amount of boron or the like is about 100–10,000 ppm, and its resistivity decreases substantially in inverse proportion to the doping amount and is about 10–0.01 Ωm.

When the substrate temperature is maintained at about 600–900° C., deposition of a carbon radical on the substrate surface is initiated. At this time, since the non-diamond components are etched with a hydrogen radical, only the diamond layer substantially grows. The deposition rate is usually 0.1–5 μm/hr. It can be estimated that a stable carbide layer that is formed on the substrate under this deposition condition contributes to an enhancement of the bonding strength.

The thickness of the conductive diamond layer is preferably 0.1–100 μm, and more preferably 1–10 μm, in view of the electrode durability (protection of the substrate), production costs, and the like.

It is confirmed from the SIMS analysis that a B/C ratio of the feed gas and the formed layer is substantially equal. It can be confirmed by the Raman spectrum that the coated layer formed by the CVD process is diamond. It can be confirmed from the observation of SEM photographs that polycrystalline diamond having a particle size of about 0.1–10 μm is deposited.

With respect to the material quality and shape of the foregoing substrate, there are no particular limitations so far as the material quality is conductive. For example, plate-shaped materials, rod-shaped materials, mesh-shaped materials, pipe-shaped materials, sphere-shaped materials (for example, beads), or perforated plate-shaped materials as a chatter fibrous sintered body, made of conductive silicon (for example, mono-crystalline, polycrystalline, or amorphous silicon), silicon carbide, titanium, niobium, tantalum, zirconium, carbon, nickel, etc. However, it is desired from the standpoints of consistency of coefficient of thermal expansion and stability in a hydrogen atmosphere that a substrate made of silicon is used. However, since silicon is a semi-conducting material, it is necessary to dope it with boron or the like so as to have good conductivity. To obtain a mechanical strength and enhance adhesion to conductive diamond, it is preferred to provide the surface of the substrate with irregularities. Further, in order to promote the deposition of diamond, it is sometimes important to polish or nucleate it with diamond particles.

With respect to the cathode used in the present invention, there are no particular limitations so far as it is durable to the electrolytic solution, especially alkalis, and actuates at a relatively high pH. Examples of the cathode include lead, nickel, nickel alloys, titanium, zirconium, graphite, platinum, and conductive diamond. To lower the voltage, it is preferable that the surface is coated with a component having an excellent catalytic activity (for example, platinum group metals and oxides thereof). It is also possible to use a gas diffusion cathode.

The shape of the cathode is not limited, and plate-shaped materials, rod-shaped materials, mesh-shaped materials, or perforated plate-shaped materials as a chatter fibrous sintered body can be used.

In the present invention, the electrolysis may be carried out while feeding an oxygen-containing gas into a cathode chamber to suppress the generation of hydrogen in the cathode chamber side, thereby reducing a cell voltage, i.e., reducing an electric power to be consumed. When a specific catalyst is used, reduction reaction of an oxygen gas preferentially proceeds as the cathodic reaction to form hydrogen peroxide. Since the generation of this hydrogen peroxide occurs with good efficiency in an alkaline aqueous solution atmosphere, it is desired to use an alkaline aqueous solution as the raw material.

As the specific catalyst for the formation of hydrogen peroxide, platinum group metals and oxides thereof, and carbon such as graphite and conductive diamond can be preferably used. Besides, organic material such as polyanilines and thiols (SH-containing organic materials) can be used. Such a catalyst is used in the plate-shaped state as it is, or it is coated and formed at a coverage of 1–1,000 g/cm$^2$ on a plate having durability such as stainless steel and carbon, a metal net, a powdered sintered body, or a metallic fiber sintered body by the heat decomposition method, the fixing method by a resin, the composite plating method, etc.

As a cathode current feeder, carbon, metals such as nickel and stainless steel, and alloys or oxides thereof can be used. To rapidly perform the feeding and removal of gases and liquids, it is preferable that a hydrophobic or hydrophilic material is dispersed in and supported on the current feeder. When a hydrophobic sheet is formed on the back surface of the cathode in the opposite side to the anode, the gas feeding to the reaction surface can be controlled, and hence, such is effective.

The feeding amount of oxygen is about 1.1–10 times the theoretical amount. As the oxygen source, air, oxygen resulting from separation and concentration of air, oxygen in a cylinder, and the like can be used. Where a gas chamber is present in the cathode chamber, oxygen is fed into this gas chamber. However, oxygen may be previously blown into and absorbed on the catholyte.

In the present invention, when the electrolysis is carried out using a conductive diamond electrode as the anode while feeing a carbon dioxide gas or an electrolytic solution having carbon dioxide dissolved therein into the anode chamber and feeding an oxygen-containing gas into the cathode chamber, it is possible to produce hydrogen peroxide in the cathode chamber while forming a peroxo-carbonate compound in the anode chamber. The hydrogen peroxide produced in the cathode chamber can be utilized for the oxidation of a carbonate ion or a bicarbonate ion, i.e., synthesis of a peroxo-carbonate, whereby the overall current efficiency (200% at maximum as pair reaction between a cathode and an anode) can be increased.

The resulting peroxo-carbonate, especially its salt, can be deposited with good efficiency and separated by charging the electrolytic solution in an external reaction vessel and cooling it.

The electrolytic cell used may be of a non-diaphragm type or a diaphragm type. When an anode chamber and a cathode chamber are partitioned from each other by a diaphragm, the formed peroxo-carbonate, hydrogen peroxide, or the like does not cause decomposition upon contact with the counter electrode.

The diaphragm that can be used is not particularly limited so far as it is chemically stable. Examples of ion exchange membranes include fluorine resin based membranes and hydrocarbon resin based membranes, but the former is preferable from the standpoint of corrosion resistance. Resins having excellent chemical resistance are, for example, fluorinated resins having a sulfonic acid group as an ion exchange group (Nafion, a registered trademark, as a commercially available product). Nafion is produced from a copolymer of tetrafluoroethylene and perfluoro[2-(fluorosulfonyl-ethoxy)-propyl]vinyl ether.

Materials of the electrolytic cell that can preferably used are glass lining materials, carbon, and titanium, stainless steel and PTFE resins each having excellent corrosion resistance, from the standpoints of durability against the electrolytic solution and stability of hydrogen peroxide.

In the present invention, the electrolysis conditions are not particularly limited. When the temperature is high, the reaction rate increases, and the reaction reaches an equilibrium state within a short period of time. However, the decomposition rate increases, too. Accordingly, an appropriate temperature range is preferably 0–60° C., more preferably 0–30° C., and most preferably 0–10° C. The current density is preferably about 0.05–0.5 A/cm$^2$, and it is desired that the current density is constant over the overall reaction.

The distance between the electrodes should be made small for reducing a resistance loss. However, in the case of feeding the electrolytic solution, it is desired to set up the distance at 1–50 mm for making a pressure loss of a pump small and maintaining the pressure distribution uniform.

With respect to the peroxo-carbonate to be formed, if a compound exceeds the solubility, the compound is obtained as a precipitate and can be purified with good efficiency upon separation. However, since the peroxo-carbonate is frequently used as a solution for cleaning or sterilization, it is possible to form a peroxo-carbonate or its compound within the solubility range and use its solution as it is. The amounts of peroxo-carbonate and hydrogen peroxide formed can be continuously controlled by adjusting the water amount and the current density.

To synthesize a peroxo-carbonate with good efficiency, it is preferred to maintain a carbon dioxide gas as the raw material at high pressure and also to maintain an electrolytic solution storage tank described hereinafter and the respective electrolytic chambers at high pressure. An optimum pressure range is 0.1–2 MPa.

In the present invention, a carbon dioxide gas is fed into an electrolytic cell having a gas diffusion anode and a cathode, or a solution having a carbon dioxide gas dissolved therein is fed into an electrolytic cell having an anode and a cathode, thereby electrolytically converting the foregoing carbon dioxide gas into a peroxo-carbonate.

It is possible to surely produce a useful peroxo-carbonate using inexpensive carbon dioxide as the raw material.

Embodiments of electrolytic lines containing an electrolytic cell capable of being used for the production of a peroxo-carbonate according to the present invention will be described below with reference to FIGS. 1 and 2.

Figure 2:
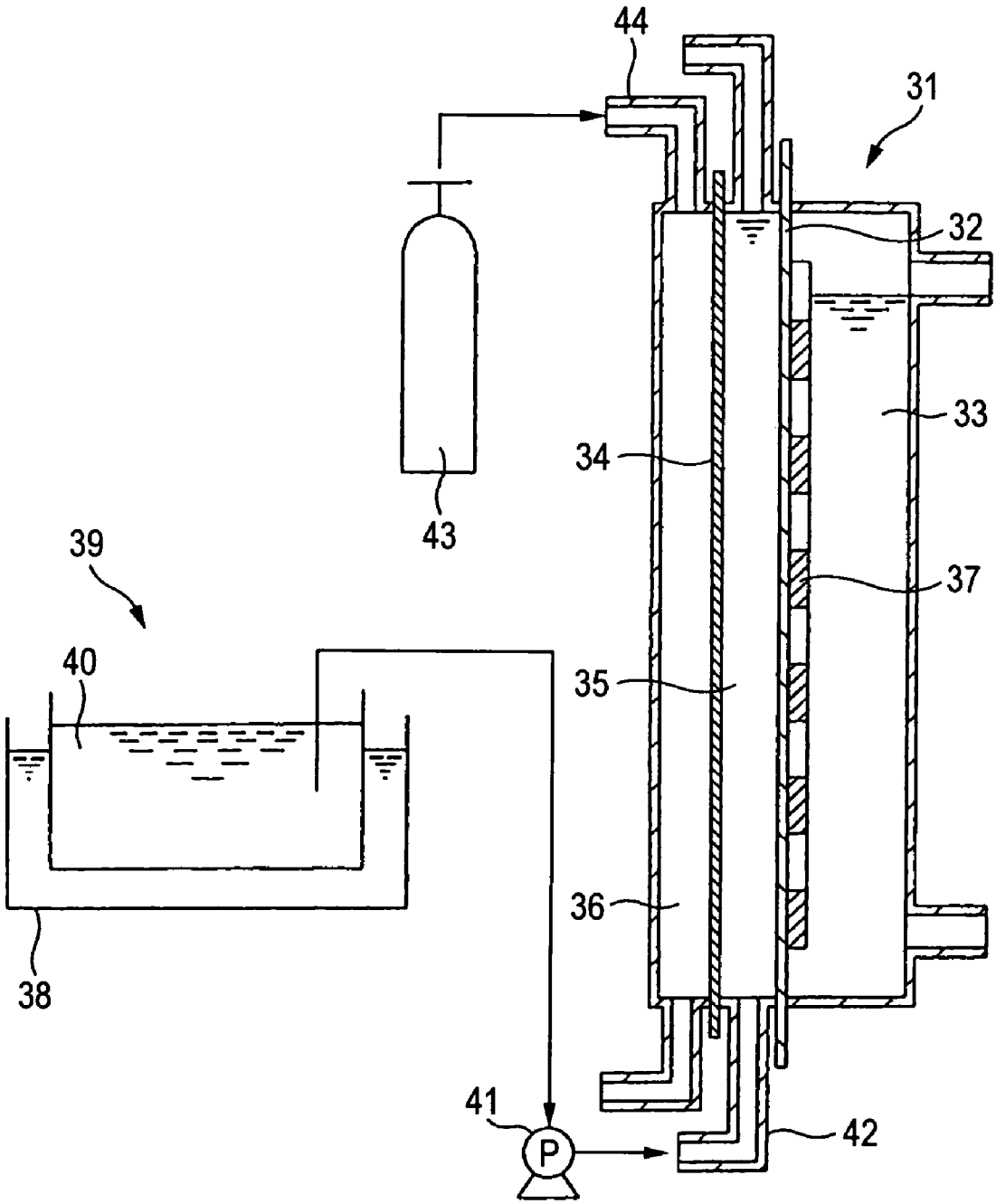
FIG. 2 is a flowchart showing another embodiment of electrolytic lines containing an electrolytic cell capable of being used for the production of a peroxo-carbonate according to the present invention.

FIG. 1 is a flowchart showing one embodiment of electrolytic lines containing an electrolytic cell capable of being used for the production of a peroxo-carbonate according to the present invention; and FIG. 2 is a flowchart showing another embodiment of the same.

In FIG. 1, an electrolytic solution 12 having sodium hydroxide as an electrolyte dissolved therein is stored in an electrolytic solution storage tank 11. A carbon dioxide gas in a carbon dioxide gas cylinder 13 is bubbled into this electrolytic solution 12, and preferably, the carbon dioxide gas is saturated in the electrolytic solution 12. The electrolytic solution storage tank 11 is dipped in a cooling tank 14, thereby cooling the electrolytic solution 12 to a proper temperature and increasing the saturation amount of carbon dioxide dissolved in the electrolytic solution 12.

This electrolytic solution 12 having a carbon dioxide gas dissolved therein is circulated into a lower inlet 17 of an electrolytic cell 16 for producing a peroxo-carbonate using a pump 15. The electrolytic cell 16 is a non-diaphragm type electrolytic cell containing an anode 18 in which a boron-doped conductive diamond powder is coated on a substrate and a cathode 19 made of a platinum plate or the like. An electrolytic solution 20 having a carbon dioxide gas dissolved therein within the electrolytic cell 16 comes into contact with the anode 18 and is oxidized to form a peroxo-carbonate.

When the peroxo-carbonate formed in the anode 18 comes into contact with the cathode 19 as a counter electrode, there is some possibility that the peroxo-carbonate is reduced into original carbon dioxide. Accordingly, it is desired to rapidly discharge the electrolytic solution 20 containing the formed peroxo-carbonate from an upper outlet 21.

FIG. 2 shows electrolytic lines including a diaphragm type electrolytic cell having a gas diffusion electrode.

A diaphragm type electrolytic cell 31 is partitioned into an anode chamber and a cathode chamber 33 by a diaphragm 32 such as an ion exchange membrane. The anode chamber is further partitioned into an anolyte chamber 35 and an anode gas chamber 36 by a sheet-shaped gas diffusion anode 34 resulting from baking of a mixture of a diamond powder as a catalyst and a PTFE resin. A cathode 37 made of a platinum performed plate is contained in the cathode chamber 33.

An electrolytic solution 40 having sodium hydroxide as an electrolyte dissolved therein is stored in an electrolytic solution storage tank 39 dipped in a cooling tank 38. This electrolytic solution 40 is fed into the anolyte chamber 35 from an electrolytic solution inlet 42 in the lower portion of the electrolytic cell 31 using a pump 41, and a carbon dioxide gas in a carbon dioxide gas cylinder 43 is fed into the anode gas chamber 36 from a carbon dioxide inlet 44 in the upper side of the electrolytic cell 31.

The carbon dioxide fed into the anolyte chamber 35 is directly electrolytically oxidized on the anode according to the reaction formula (3) to form a peroxo-carbonate.

Since this electrolytic cell 31 is partitioned into an anode chamber and a cathode chamber by the diaphragm 32, the peroxo-carbonate formed in the anode gas chamber does not cause decomposition upon contact with the cathode 37, and the desired product is obtained in a high yield.

Examples of the production of a peroxo-carbonate according to the present invention will be described below, but it should not be construed that the present invention is limited thereto.

EXAMPLE 1

Using the electrolytic lines shown in FIG. 1, an electrolytic cell was constructed as follows.

A conductive diamond layer having a thickness of 5 μm and a doping amount of boron of 500 ppm was formed on a conductive silicon substrate having a thickness of 1 mm by a heat filament CVD process using ethyl alcohol as a carbon source, to prepare an anode having an electrode area of 1 $cm^2$. A platinum plate having an electrode area of 1 $cm^2$ was used as a cathode.

Using the above anode and cathode, a non-diaphragm type electrolytic cell having a volume of 100 ml as shown in FIG. 1 was assembled so as to have a distance between the electrodes of 5 cm.

A carbon dioxide gas was saturated in salt water by bubbling for 30 minutes at the beginning while cooling the storage tank, and bubbling was continued during the electrolysis operation.

Electrolysis was carried out by passing a constant current while feeding a fixed amount of the salt water into the electrolytic cell. As a result, sodium percarbonate in the crystal state was isolated. When the product was identified by an X-ray powder diffraction pattern, a sample of commercially available sodium percarbonate had the same peaks as those in sodium percarbonate obtained in this Example.

Figure 3:
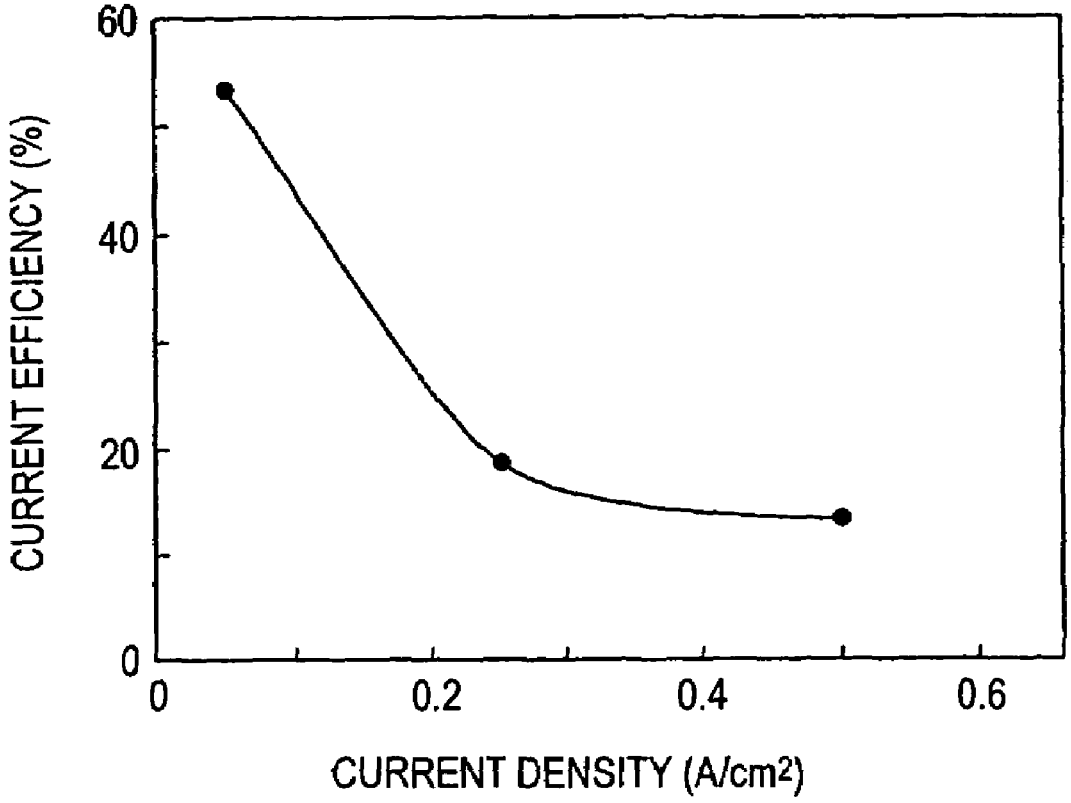
FIG. 3 is a graph showing the current density dependency of current efficiency in Example 1.

The production of a peroxo-carbonate was carried out under the same conditions, except that the current density was changed to 0.05 $A/cm^2$, 0.25 $A/cm^2$ and 0.50 $A/cm^2$, respectively, and the current efficiency of the production of a carbonic acid in each of the cases was measured. As a result, the current efficiency was respectively about 54%, about 20% and about 13% in that order. These results were plotted in a graph of FIG. 3. The maximum current efficiency was 54% at a current density of 0.05 $A/cm^2$. Thus, it was seen that when the current density is low, a peroxo-carbonate can be produced at a high current efficiency.

The production of a peroxo-carbonate was carried out under the same conditions, except for changing the initial pH. As a result, it was seen that when the pH is lower than 10, the current efficiency is low, whereas when the pH is 10 or higher, the current efficiency is maintained high.

The concentration of the peroxo-carbonate in the solution was measured by mixing 1 ml of a sample solution and 5 ml of a 45 volume % sulfuric acid aqueous solution and titrating liberated hydrogen peroxide with potassium permanganate.

EXAMPLE 2

Electrolytic lines shown in FIG. 2 were prepared using a sheet having a thickness of 0.4 mm as a gas diffusion anode, which had been prepared by kneading a boron-doped diamond powder as an anode catalyst and a PTFE resin and baking the mixture at 330° C., a platinum plate as a cathode, and an ion exchange membrane (Nafion 117, manufactured by Du Pont) as a diaphragm. A carbon dioxide gas was fed at a constant rate into an anode gas chamber.

The production of a peroxo-carbonate was carried out under the same conditions as in Example 1 other than those described above. As a result, the maximum current efficiency was 45% at a current density of 0.05 $A/cm^2$.

EXAMPLE 3

The production of a peroxo-carbonate was carried out under the same conditions as in Example 1, except that the electrolytic cell was partitioned into an anode chamber and a cathode chamber using an ion exchange membrane (Nafion 117, manufactured by Du Pont).

The maximum current efficiency was 50% at a current density of 0.05 $A/cm^2$.

It should further be apparent to those skilled in the art that various changes in form and detail of the invention as shown and described above may be made. It is intended that such changes be included within the spirit and scope of the claims appended hereto.

This application is based on Japanese Patent Application No. 2003-381105 filed Nov. 11, 2003, the disclosure of which is incorporated herein by reference in its entirety.

What is claimed is:

1. A process of producing a peroxo-carbonate, which comprises feeding a carbon dioxide gas into an electrolytic cell having a gas diffusion anode and a cathode chamber, feeding oxygen into the cathode chamber to produce hydrogen peroxide, and electrolytically converting the carbon dioxide gas into a peroxo-carbonate.

2. The process as claimed in claim 1, wherein the anode contains a conductive diamond electrode and/or conductive diamond as a catalyst.

3. The process as claimed in claim 1, wherein the electrolytic cell is partitioned into an anode chamber and a cathode chamber by a diaphragm.

4. The process as claimed in claim 1, wherein the conversion is carried out at a pH of 7 or higher.

5. The process as claimed in claim 1, wherein the conversion is carried out at a temperature lower than 30° C.

6. The process as claimed in claim 1, which comprises oxidizing carbonate ion or bicarbonate ion with hydrogen peroxide produced in the cathode chamber to generate a peroxo-carbonate.

7. The process as claimed in claim 6, wherein the anode contains a conductive diamond electrode and/or conductive diamond as a catalyst.

8. A process of producing a peroxo-carbonate, which comprises feeding a liquid having a carbon dioxide gas dissolved therein into an electrolytic cell having an anode and a cathode chamber, feeding oxygen into the cathode chamber to produce hydrogen peroxide, and electrolytically converting the carbon dioxide gas into a peroxo-carbonate.

9. The process as claimed in claim 8, wherein the anode contains a conductive diamond electrode and/or conductive diamond as a catalyst.

10. The process as claimed in claim 8, wherein the electrolytic cell is partitioned into an anode chamber and a cathode chamber by a diaphragm.

11. The process as claimed in claim 8, wherein the conversion is carried out at a pH of 7 or higher.

12. The process as claimed in claim 8, wherein the conversion is carried out at a temperature lower than 30° C.

13. The process as claimed in claim 8, which comprises oxidizing carbonate ion or bicarbonate ion with hydrogen peroxide produced in the cathode chamber to generate a peroxo-carbonate.

14. The process as claimed in claim 13, wherein the anode contains a conductive diamond electrode and/or conductive diamond as a catalyst.

* * * * *